United States Patent [19]

Fusselman et al.

[11] Patent Number: 4,723,916

[45] Date of Patent: Feb. 9, 1988

[54] PIN PLUG AND SOCKET CONNECTOR USING INSULATION DISPLACEMENT CONTACTS

[75] Inventors: David F. Fusselman, Middletown; Timothy A. Lemke, Carlisle, both of Pa.

[73] Assignee: E. I. Du Pont de Nemours and Company, Wilmington, Del.

[21] Appl. No.: 922,260

[22] Filed: Oct. 23, 1986

[51] Int. Cl.[4] ..... H01R 4/66; H01R 13/652

[52] U.S. Cl. ..... 439/92; 439/607

[58] Field of Search ..... 339/14 P, 97–99, 339/143 R, 176 M, 106; 439/92, 395, 455, 607–610

[56] References Cited

U.S. PATENT DOCUMENTS 2,181,576 11/1939 Chirelstein ..... 339/97 R
2,593,743 4/1952 Galvao ..... 339/97 R
3,274,530 9/1966 Michaely ..... 339/97
4,684,197 8/1987 Reichardt et al. ..... 439/608 X

FOREIGN PATENT DOCUMENTS 635745 1/1962 Canada ..... 339/14 P
476897 5/1929 Fed. Rep. of Germany ..... 339/106

*Primary Examiner*—Eugene F. Desmond

[57] ABSTRACT

A circular pin plug and socket connector has a conductor support block with a central axial bore therethrough and with a plurality of grooves extending radially from the bore. A cable having a plurality of conductors is received through the bore, with the conductors in the cable flaring radially into an individual ones of the grooves. The grooves are arranged to receive and to orient the individual conductors of the cable along a predetermined presentment angle. Each groove has a pair of slots associated therewith. The slots are sized to receive the tines of insulation displacement contact. The slots are arranged on a circular locus centered on the axis of the bore.

2 Claims, 4 Drawing Figures

Fig. 2
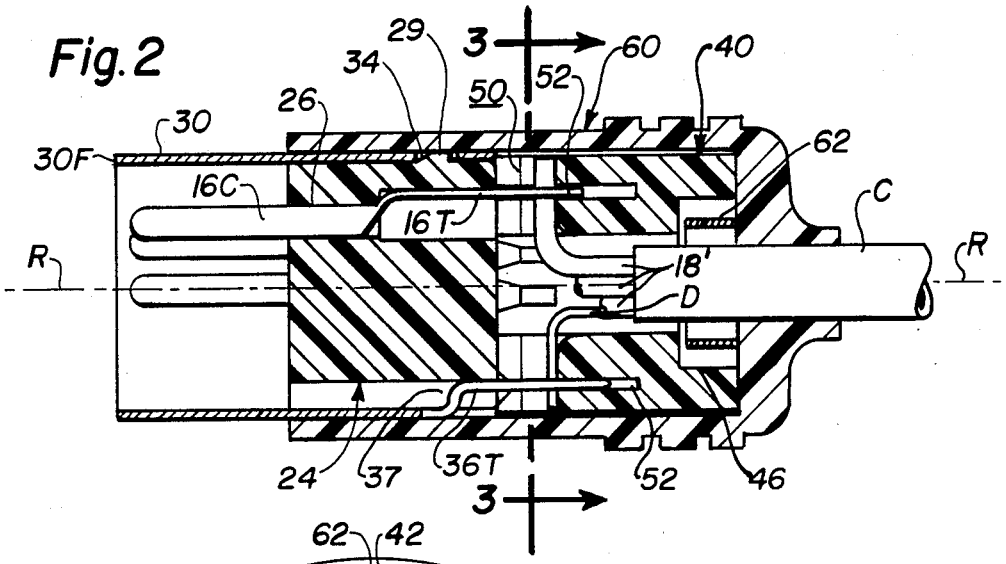
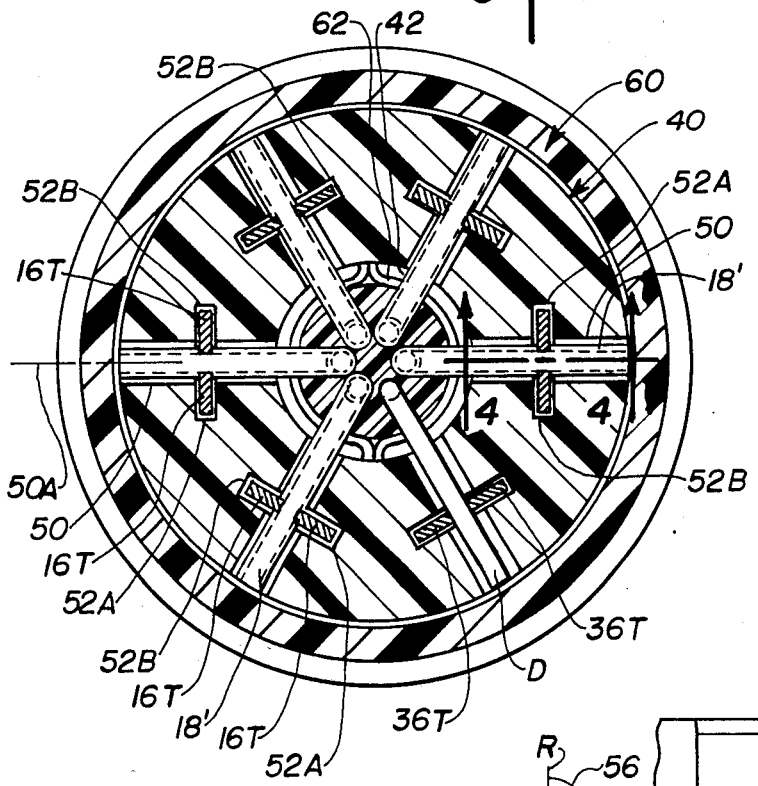
Fig. 3
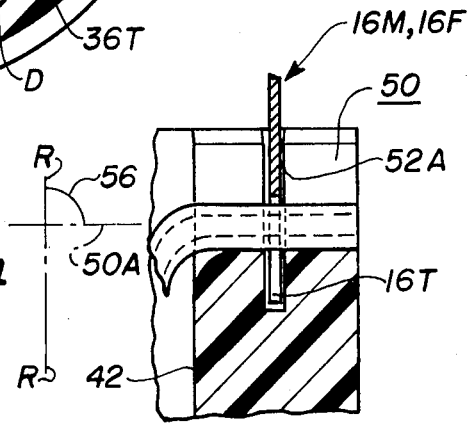
Fig. 4

PIN PLUG AND SOCKET CONNECTOR USING INSULATION DISPLACEMENT CONTACTS

BACKGROUND OF THE INVENTION

1. Field of the Invention

The present invention relates to a pin plug and socket connector and, in particular, to such a connector using insulsation displacement contacts.

2. Description of the Prior Art

A pin plug and socket connector is an electrical interconnection device which usually finds utility in instances where space constraints mandate a compact intercommunication arrangement. Such as in the input/output keyboard of a personal computer or in a microphone jack. The pin plug is a device, generally cylindrical in shape, in which a plurality of generally cylindrical projecting pins are individually connected, in the typical case, to a respective one of a plurality of electrical conductors arranged in a multi-conductor cable. The complementary socket assembly has an insulating body member with an array of female contacts corresponding in number and location to each of the pins. The socket typically mounted in the chassis or casing of a user apparatus. When the pins are received by the sockets electrical interconnection is made between the particular electronic circuits in the user apparatus that are connectecd to the female contacts in the socket and the individaul conductors of the cable.

When manufacturing a typical plug for a pin plug and socket connector the individual conductors of the cables are stripped, that is, the outside insulation jacket removed, and thereafter soldered directly to the trailing end of each of the pin contacts through a solder cup. Alternatively, the stripped ends of the cable are individually crimped to the end of the pin and the pins thereafter manually inserted into a suitable mounting block to define an array of pins projecting from the body of the block. The mounting block includes a hollow shell surrounding the pins. The pins of the plug are shielded by soldering the shielding element of the cable (either a drain wire, shield wire or a metallic braid) to the hollow metallic shell. The entire assembly is thereafter surrounded using an elastomeric boot which serves to provide strain relief for the plug.

As may be appreciated the manufacturing process used to form the pin plug is both labor and skill intensive. Accordingly, both the quality and yield of the product produced by such a labor and skill intensive manufacturing process is difficult to control. Moreover, the process is inherently costly. Still further, because of the use of a post-molded elastomeric boot as a strain relief for the cable the product is unrepairable in the event of a defect. Ironically, the boot itself often does not provide adequate strain relief.

An isulation displacement contact is a metallic conducting element stamped and formed into an elongated main body member with a pair of resilient tines trailing therefrom. Electrical interconnection between an individual conductor and such a contact is made by pressing the still-jacketed conductor into the space between the resilient tines of the contact. As the conductor is advanced along the tines the insulating jacket of the conductor is sheared by the inner edges of the tines, thus permitting an electrical interconnection to be made between the tines of the contact and the wire of the conductor. U.S. Pat. No. 4,431,249 discloses a connector using insulation displacement contacts. Such insulation displacement contacts are believed more efficient from a manufacturing standpoint in that the insulating jacket of an individual conductor need not be previously stripped in order to effect the interconnection between the wire of the conductor and the contact, as is the case of a solder or crimped connection. However, when effecting the interconnection using an insulation displacement contact it is necessary that the axis of the wire of the conductor be oriented at some predetermined presentment angle with respect to the axes of the tines of the contact so that the shearing action of the tines can most effectively occur.

In view of the foregoing it is believed advantageous to provide a pin plug and socket connector which utilizes insulation displacement contacts in the plug and/or the socket whereby the specific problems of labor intensity, product quality, product yield and cost associated with the manufacture of the circular pin plug would be minimized or solved.

SUMMARY OF THE INVENTION

The present invention relates to a pin plug and socket connector which uses contact elements of the insulation displacement type. Such a contact includes a body portion having a pair of tines trailing thereform. In its broadest aspect the connector includes a socket and complementary plug one or both of which includes a conductor support block having a presentment surface thereon with a central axial bore extending therethrough. The presentment surface of the support block has a radial array of conductor-receiving grooves formed therein. A pair of slots are associated with each groove such that the slots are in opposed relation with respect to the axis of the groove with which they are associated. The slots are located on a circular locus centered on the axis of the bore. Each of the conductors of a cable extends axially through the bore of the support block and then bends substantially radially outwardly into one of the grooves. Each conductor is thus oriented at a predetermined presentment angle whereby the insulating jacket of the conductor in a groove is sheared by the tines of an insulation displacement contact as the same are received in the slots associated with the groove to interconnect electrically the contact element with the conductive wire of the conductor.

The conductor support block has a receptacle on the second end surface thereof. The receptacle communciates with the bore and is arranged to accept a strain relief collar attached to the cable.

The contacts are carried in a contact mounting block having a cylindrical shell thereon. The shell has a pair of insulation displacement tines trailing therefrom, with the tines being offset from the shell. The tines of the shell are receivable in the slots associated with one of the grooves to electrically interconnect the shell with a drain wire connected to the shield of the cable that is receivable in one of the grooves of the conductor support block.

BRIEF DESCRIPTION OF THE DRAWINGS

The invention will be more fully understood from the following detailed description thereof, taken in connection with the accompanying drawings, which form a part of this application and in which:

FIG. 2 is a side elevational view entirely in section of the pin plug portion of the connector in accordance with the present invention in its assembled condition;

FIG. 3 is a section view taken along section line 3—3 of FIG. 2; and,

FIG. 4 is a section view taken along section lines 4—4 of FIG. 3.

DETAILED DESCRIPTION OF THE INVENTION

Figure 1:
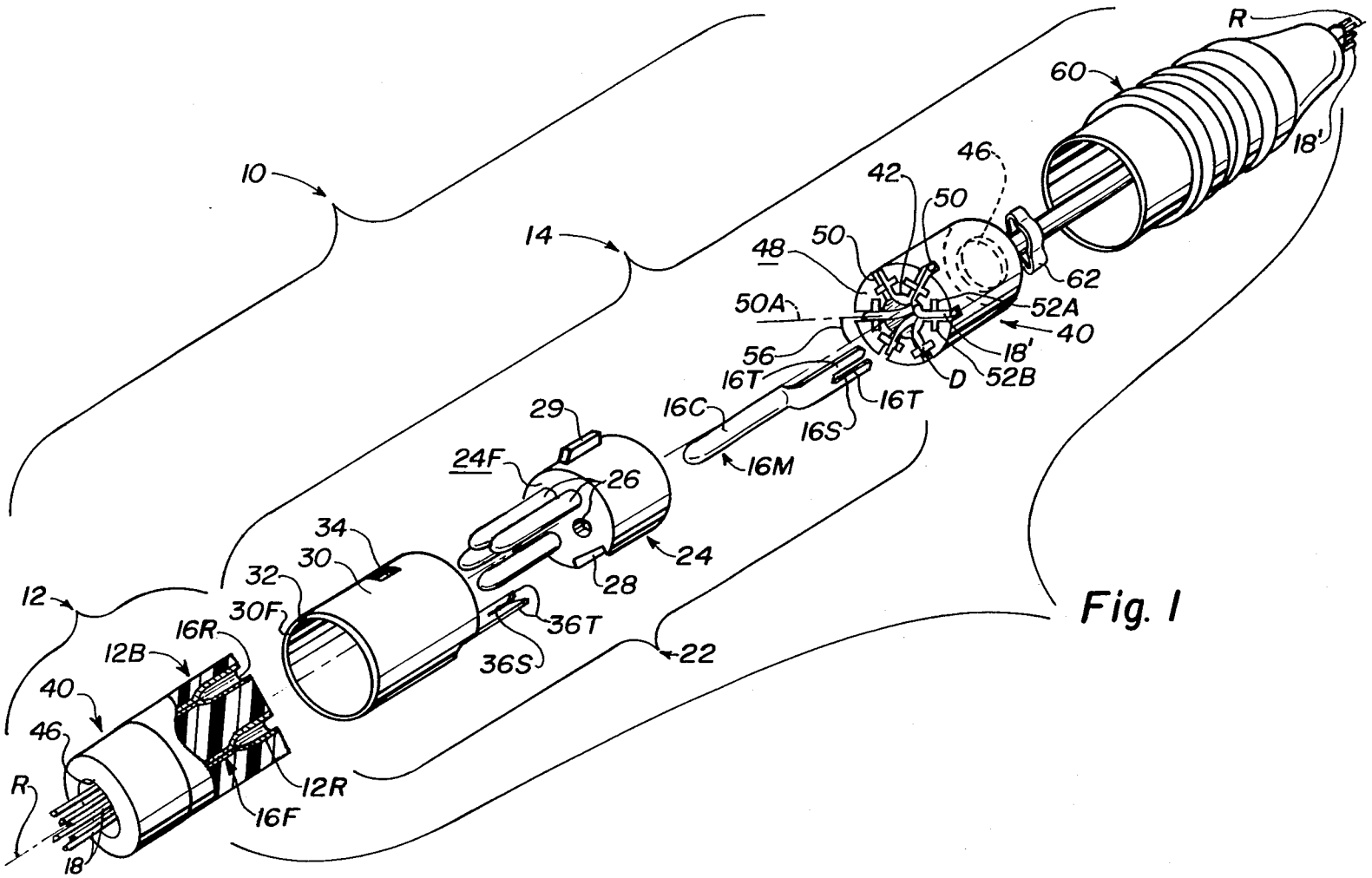
FIG. 1 is perspective view of a pin plug and socket connector embodying the teachings of the present invention with the elements comprising the pin plug being exploded.

Throughout the following detailed description similar reference numerals refer to similar elements in all figures of the drawings.

With reference to the figures shown is a pin plug and socket connector generally indicated by reference character 10. The connector 10 includes a socket 12 and a pin plug 14, one or both of which, by virtue of a conductor support block 40 in accordance with this invention, may be adapted to use contact elements of the insulation displacement type. The reference character 16 is used herein to refer generally to such insulation displacement contacts. Typically the socket 12 is mounted in the chassis of a user apparatus (not shown), such as a personal computer, while the pin plug 14 is connected to the end of a multi-conductor cable C.

The socket 12 includes an insulating body member 12B having an annular array of recesses 12R therein. Suitable insulation displacement contacts 16F of the female type, each having a receptacle portion 16R, are arranged in the recesses 12R of the body 12B. When a conductor support block 40 to be described is joined to the body 12B electrical connection is made between the conductors 18 from circuirty within the user apparatus and the female insulation displacement contacts 16F.

The pin plug 14, when joined with the complementary socket 12, is arranged to interconnect the individual conductors 18' of the cable C to the conductors 18 connected with the socket 12. The cable C may contain a suitable ground shield, such as a braid, which is connected to a drain wire D (best seen in FIG. 3), as is customary in the art. As used herein the term drain wire is used to refer to a wire that is electrically connected to the ground shield of the cable, however that ground shield is implemented.

As seen in the Figures and as discussed herein the connector 10 exhibits a circular configuration. However, it should be understood that the present invention facilitating the use of insulation displacement contact elements 16 may be used with a pin plug and socket connector 10 of any predetermined configuration.

The pin plug 14 includes a contact assembly 22 having a contact mounting block 24. The mounting block 24 has an annular array of contact receiving bores 26 extending therethrough. A positioning keyway 28 and a latching land 29 are provided on the peripheral surface of the mounting block 24. Although the array of contact receiving bores 26 is shown as annular it should be understood that any convenient positioning of the bores 26 within the mounting block 24 may be effectuated. A corresponding arrangement of the recesses 12R in the body 12B of the socket 12 is, of course, provided. The mounting block 24 is typically fabricated of a dielectric material, such as plastic.

An array of male, or pin, contact elements 16M are mounted in the contact mounting block 24. The male pin contact elements 16M differ from the female contacts 16F in that each includes a forwardly projecting cylindrical portion 16C as opposed to the receptacle portion 16R provided with the female contact 16F. However, the remaining structure of the contacts 16 is identical. A pair of tines 16T trails from the forward portion 16R or 16C of the contact, as the case may be. The tines 16T are generally parallel to each other and and offset with respect to the forward portion of the contact. A space 16S is defined between the confronting inner edges of the tines 16T. To secure the contact element 16 in place within the body 12B or the mounting block 24, as the case may be, the tines 16T are provided with barbs or serrations (not shown).

A hollow cylindrical metal shell 30 is formed from a substantially rectangular flat conductive strip of material which is bent or otherwise formed into a substantially cylindrical arrangement by bringing the opposed ends of the strip into juxtaposition with each other along a junction line 32. The shell member so formed has a window 34 defined therein. Formed integrally with the shell 30 is a rearwardly projecting pair of tines 36T of the insulation displacement type. The tines 36T are offset inwardly of the shell 30 as shown at 37 (FIG. 2) to lie substantially on the same radius from the reference axis R—R as do the tines 16T from the contacts 16M. A space 36S is defined between the confronting inner surfaces of the tines 36T.

When assembled, as shown in FIG. 2, the barbs on the contact elements 16M secure the same in place in the mounting block 24 with the cylindrical portions 16C extending forwardly from the front face 24F of the mounting block while the tines 16T extend rearwardly from the opposite face thereof. The shell 30 is positioned on the mounting block 24 by the receipt of the projecting tines 36T on the shell 30 into the keyway 28 of the mounting block 24. The shell 30 is retained to the mounting block 24 by the receipt of the land 29 into the window 34. When assembled, the forward edge 30F of the shell 30 projects further forwardly from the face 24F of the mounting block 24 than do the forward ends of the cylindrical portions 16C of the contacts 16M.

In accordance with the present invention a conductor support block 40 having a central axial bore 42 extending therethrough is used to present the conductors 18 (in the case of the socket 12) or the conductors 18' (in the case of the pin plug 14) at an appropriate presentment angle whereby the insulation displacement contacts 16F or 16M, respectively, may shear the insulation of the conductor and electrically interconnect the contact 16 with the wire of the conductor 18 and/or 18' when the support block 40 is joined to the plug 12 or the mounting block 24, as the case may be. The back end surface 40B of the block 40 may be bored to define a receptacle, as at 46, for a purpose to be described.

The opposed front end surface 40F of the support block 40 defines a conductor presentment surface 48. The presentment surface 48 is provided with an array of grooves 50 that extend radially of the block 40. Intersecting each of the grooves 50 is a pair of slots 52A, 52B. The slots 52 in each pair are arranged in opposed relation with respect to the axis 50A of the groove 50 with which they are located. The mouth of the slots 52 intersect the presentment surface 48 so as to lie on a generally circular locus with respect to the axis R—R (conincident with the axis of the bore 24). The slots 52 each extend into the support block 40 for a distance substantially equal to the length of the tines 16T and/or 36T. The slots 52 are appropriately oriented with respect to the grooves 50 to accept the tines 16T from the contacts 16. Preferably, a line joining the axes of opposed slots 52A, 52B intersects the axis 50A of the groove 50 associated with the slots to define (in the plane of FIG. 3) an angle of ninety degrees.

The support block 40 is formed in a preferred case of an insulating material, such as plastic, and is preferably, but not necessarily, of the same external configuration as the body 12B and/or the contact mounting block 24.

The grooves 50 provided in the presentment surface 48 are arranged such that the axis 50A of each groove 50 defines a predetermined presentment angle 56 with respect to the axis R—R. In the preferred case, since the presentment surface 48 is perpendicular to the reference axis R—R of the connector 10, the presentment angle 56 is ninety degrees. However, it lies within the contemplation of this invention that the presentment angle 56 may be other than ninety degrees. The presentment angle 56 may be any predetermined angle such that a sufficient portion of an individual conductor 18, 18' (and the drain wire D in the case of the cable C) receivable within the groove 50 is presented respectively to the tines 16T on the contacts 16F and 16M (and 36T, in the case of the pin plug 14) of an insulation displacement contact element receivable within the slots 52 associated with the groove 50. This permits the insulation displacement action of the tines to occur and electrically connect the wire of the conductor with the tines.

The pin plug 14 in accordance with the present invention is assembled by producing the contact assebly 22 comprising the pin contact elements 16, the contact mounting block 24 and the shielding shell 30 as hereinabove discussed. At any other convenient time the cable C is inserted through an opening in the end of an insulating boot 60. secured to a strain relief collar 62 and thence inserted axially through the central bore 42 of the conductor support block 40. The insulating outer jacket of the cable C is removed either before or after the insertion of the cable C through the above-mentioned elements (40, 60 and 62) so that the individual conductors 18' and the drain wire D contained within the cable C extend axially through the support block 40 and project through the mouth of the bore 42. As may be appreciated the support block 40 provides a convenient structure for organizing the individual conductors 18' or drain wire D of the cable C and for positioning them in a regular and predetermined arrangement so that an effective insulation displacement engagement may be made between the wires carried within the individual conductors 18' and the tines 16T of each of the male contact elements 16M.

To accomplish this end the individual conductors 18' and the drain wire D are bent radially outwardly (relative to the reference axis R—R) and are inserted into a predetermined one of the radially extending grooves 50 formed in the conductor presentment surface 48 defined on the end face 40F of the block 40. The ends of the conductors 18' and the drain wire D are trimmed flush with the peripheral surface of the block 40. When received in the grooves 50 the individual conductors 18' (or the drain wire D, as the case may be) are oriented in the groove 50 at the predetermined presentment angle 56. The conductor support block 40 and the contact pin assembly 22 are displaced relative to each other along the reference axis R—R and joined such that the tines 16T at the trailing end of each of the pin contact elements 16M are received within a pair of slots 52 associated groove 50. Since the grooves 50 serve to position the conductors generally perpendicular to the slot 16S between the tines 16T of each contact 16M an effective insulation displacement engagement is made between the wires of the individual conductors 18' and the individual pin contact elements 16 as the tines 16T are inserted into the slots 52.

It should be noted that the presentment angle of ninety degrees is preferred not only because the most effective insulation displacement engagement can be made at this presentment angle but also because the right angle bend induced into the conductors 18' provides a secure mechanical strain relief which protects against mechanical disruption of the engagement due to movement of the cable with respect to the contacts.

As noted above the drain wire D of the cable C is also received in one of the grooves 50. Due to the offset 37 in the shell 30 the tines 36T are thus also receivable in one pair of the slots 52. An insulation displacement engagement can thus be effectuated between the drain wire D of the cable C and the shell 30 of the pin plug 14. Any suitable indicia or keying may be used to insure that the tines 36T are received into the appropriate slots 52.

The insulating boot 60 is thereafter slipped over the conjoined assembly and suitably secured (as by a press fit) to hold the mounting block 24 and the support block 40 of the pin plug 14 in the described assembled state. When secured, the forward end 30F of the shell 30 extends beyond the end 60F of the boot 60. The movement of the boot 60 traps the collar 62 in the receptacle 46, thus providing additional strain relief. By positioning the receptacle 46 in the back surface 40B of the support block 40 the strain relief collar 62 for the cable 10 acts against the boot 60, thus further protecting against the possibility that the conductors 18' (and the drain wire D) will be drawn from the contacts 16M. The boot 60 may be slidably removable from the plug 14 in the event that repair is required.

As noted earlier, a socker 12 may also or alternatively be fabricated using female connectors of the insulation displacement type. The individual conductors 18 from the user apparatus are received in a similar conductor support block 40. The block 40 used in the pocket 12 serves to order the conductors 18 in a manner analogous to that earlier discussed.

The socket 12 may be prepared in a manner analogous to the manner in which the plug 14 is prepared. The conductors 18 emanating from the user circuitry are introduced axially into the bore 42 of the support block 40 used with the socket body 12B and bent radially outwardly to lay into the grooves 50 on the presentment surface 48 thereof. The tines 16T trailing from the female insulation displacement contacts 16F in the socket 12 are received into the slots 52 provided in the support block 40 as the support block 40 is joined to the body 12B, as discussed. The support block 47 may be secured to the body 12B by any suitable expedient. For example a boot (not shown) similar to the boot 60 may be press fit or otherwise secured over the body 12B and the support block 40.

To join the socket 12 to the plug 14, the socket 12 is inserted into the shell 30 so that the portions 16C of the male contacts 16M are received within the receptacles 16R of the female contacts 16F.

Although the Figures and the discussion indicate that it is the conductors 18' of the cable C that are interconnected to the pins 16M of the plug 14, the arrangement may be reversed. The socket 12 may be connected to the conductors 18' of the external cable C and the plug 14 interconnected to the conductors 18 emanating from the components of the user apparatus.

Those skilled in the art, having the benefit of the teachings of the present invention as hersinabove set forth, may affect numerous modifications thereto. These modifications are, however, to be construed as lying within the scope of the present invention as defined by the appended claims.

What is claimed is:

1. A pin plug and socket connector in which one of the pin plug or the socket is connectable to a cable having a drain wire and a plurality of conductors therein, each conductor having a conductive wire surrounded by an insulating jacket, comprising:

a contact mounting block having an array of insulation displacement contact elements supported therein, each contact having a pair of tines trailing therefrom; and, a conductor support block having a presentment surface at a first end thereof and having a central axial bore extending therethrough, the presentment surface having an array of grooves defined therein, each groove communicating with the bore, the axis of each of the grooves extending radially outwardly from the central bore, the conductor support block having an array of slots being arranged into pairs with one pair of slots being associated with each groove, the slots in each pair being arranged in opposed circumferential relationship with respect to the axis of the groove with which the pair is associated, each slot being sized to receive one of the tines from an insulation displacement contact, each slot intersecting the presentment surface on a locus that defines a circle centered on the axis of the central axial bore;

the drain wire and each conductor in the cable being respectively receivable into one of the grooves and thus being oriented at a predetermined presentment angle so as the contact mounting block is joined to the conductor support block the tines of each contact are received into the slots associated with a groove such that the insulating jacket of the conductor in each groove is sheared by the tines of contact thereby to interconnect electrically the contact elements to the wires of the cable, the contact mounting block having a cylindrical conductive shell thereon, the shell having a pair of insulation displacement tines trailing therefrom, the tines being offset from the shell so as the contact mounting block is joined to the conductor support block the tines on the shell are received into the slots associated with the groove receiving the drain wire thereby to interconnect electrically the shell to the drain wire of the cable.

2. The connector of claim 1 wherein the cable has a strain relief collar thereon and wherein the conductor support block has a second end surface thereon, the second end surface having a receptacle communicating with the bore, the receptacle being sized to receive the strain relief collar on the cable.

* * * * *